US005678325A

United States Patent [19]

Davidowitz et al.

[11] Patent Number: 5,678,325

[45] Date of Patent: Oct. 21, 1997

[54] CLOG TYPE SHOE WITH A DRAWSTRING

[75] Inventors: Ivan Davidowitz, Kingston, Pa.; Rosemary Wright, Hinckley, England

[73] Assignee: Columbia Footwear Corporation, Hazelton, Pa.

[21] Appl. No.: 584,454

[22] Filed: Jan. 11, 1996

[51] Int. Cl.[6] ..... A43B 3/14; A43B 3/12; A43C 11/00

[52] U.S. Cl. ..... 36/11; 36/11.5; 36/50.1

[58] Field of Search ..... 36/45, 50.1, 106, 36/105, 26, 11, 25 R, 57, 56, 80, 4

[56] References Cited

U.S. PATENT DOCUMENTS

| | | | |
|---|---|---|---|
| 1,061,740 | 5/1913 | Gehant . | |
| 1,795,305 | 3/1931 | Jacob | 36/26 X |
| 2,627,677 | 2/1953 | Kashian . | |
| 2,718,715 | 9/1955 | Spilman . | |
| 2,999,323 | 9/1961 | Bozza . | |
| 3,213,551 | 10/1965 | Krauss | 36/11 X |
| 3,568,338 | 3/1971 | Nadler | 36/11 |
| 4,458,373 | 7/1984 | Maslow | 36/50.1 X |
| 4,489,509 | 12/1984 | Libit | 36/50.1 X |
| 4,538,368 | 9/1985 | Mugford | 36/112 |
| 4,619,058 | 10/1986 | Gumbert | 36/102 |
| 4,742,625 | 5/1988 | Sydor et al. | 36/3 R |
| 4,856,207 | 8/1989 | Datson | 36/2 R |
| 4,870,761 | 10/1989 | Tracy | 36/51 |
| 4,896,437 | 1/1990 | Johnson | 36/1.5 |
| 4,896,438 | 1/1990 | DeBease | 36/76 R |
| 4,901,453 | 2/1990 | Gaynor | 36/113 |
| 4,942,678 | 7/1990 | Gumbert | 36/102 |
| 5,035,069 | 7/1991 | Minden | 36/113 |
| 5,067,260 | 11/1991 | Jenkins, Jr. | 36/7.1 R |
| 5,150,536 | 9/1992 | Strong | 36/7.1 R |
| 5,392,532 | 2/1995 | Bray, Jr. et al. | 36/11.5 |
| 5,491,860 | 2/1996 | Bray et al. | 12/143 A |
| 5,515,566 | 5/1996 | Ganon | 12/142 MC |
| 5,553,399 | 9/1996 | Strong | 36/9 R |

FOREIGN PATENT DOCUMENTS

| | | | |
|---|---|---|---|
| 308373 | 3/1989 | European Pat. Off. | 36/11 |
| 1499145 | 10/1967 | France . | |
| 2612930 | 9/1977 | Germany | 36/11 |
| 175408 | 2/1922 | United Kingdom . | |

OTHER PUBLICATIONS

Clog-style slipper brochure —Item No. V3045. Apr. 1996.
Wired Magazine, Jan. 1996, Simple®Shoes.

*Primary Examiner*—B. Dayoan
*Attorney, Agent, or Firm*—Oblon, Spivak, McClelland, Maier & Neustadt, P.C.

[57] ABSTRACT

A clog type shoe which includes a sole and an upper auached to the sole. The upper includes an opening through which a foot is placed. A drawstring tunnel is formed to encircle the opening and a drawstring is threaded through the drawstring tunnel. The drawstring can be tightened so that the opening of the upper is secured to a wearer's foot. Such footwear may also include a locking unit for locking a desired tension on the drawstring. A padded flap may also be attached to an underside of a forefoot portion of the opening and the upper may also include a lip portion formed at a heel of the sole.

11 Claims, 7 Drawing Sheets

CLOG TYPE SHOE WITH A DRAWSTRING

BACKGROUND OF THE INVENTION

1. Field of the Invention

The present invention is directed to a clog type shoe which includes features for ensuring that a foot is securely and comfortably placed within the clog type shoe.

2. Discussion of the Background

Clog type shoes are known. Such clog type shoes may have a sole, which may be formed of wood or a hard resin plastic, and uppers attached thereto. The uppers may be made of leather, suede, nylon, etc. Further, the uppers may be single unitary elements which are attached to the sole. In this way, such background clogs are two piece elements featuring a sole and an upper attached to the sole.

Such background clogs also have a structure in which the upper does not extend to the back of the sole, so that a wearer's foot can be easily slid into and out of the clog. This provides a drawback in such background clogs that the background clogs do not securely hold a wearer's foot, i.e., the wearer's foot can easily slip out of such background clogs.

Further, such background clogs typically contain uppers which do not have any added comfort features.

SUMMARY OF THE INVENTION

Accordingly, one object of the present invention is to provide a novel clog type shoe which provides for a wearer's foot to be securely placed therein.

Accordingly, another feature of the present invention is to provide a novel clog type shoe which can securely hold a wearer's foot with great comfort.

The present invention achieves such objectives by forming a novel clog type shoe which includes a sole and an upper attached to the sole. The upper includes an opening through which a foot is placed. A drawstring tunnel is formed to encircle the opening and a drawstring is threaded through the drawstring tunnel. This drawstring can then be tightened so that the clog type shoe securely holds a wearer's foot therein. Further, a padded flap may be attached to an underside of a forefoot portion of the opening of the upper, for added comfort and to funher ensure that a foot is secured in place within the opening. The clog may also include a locking unit for locking a desired tension on the drawstring and the upper may also include a lip portion formed at a heel of the sole.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERPED EMBODIMENTS

Figure 1:
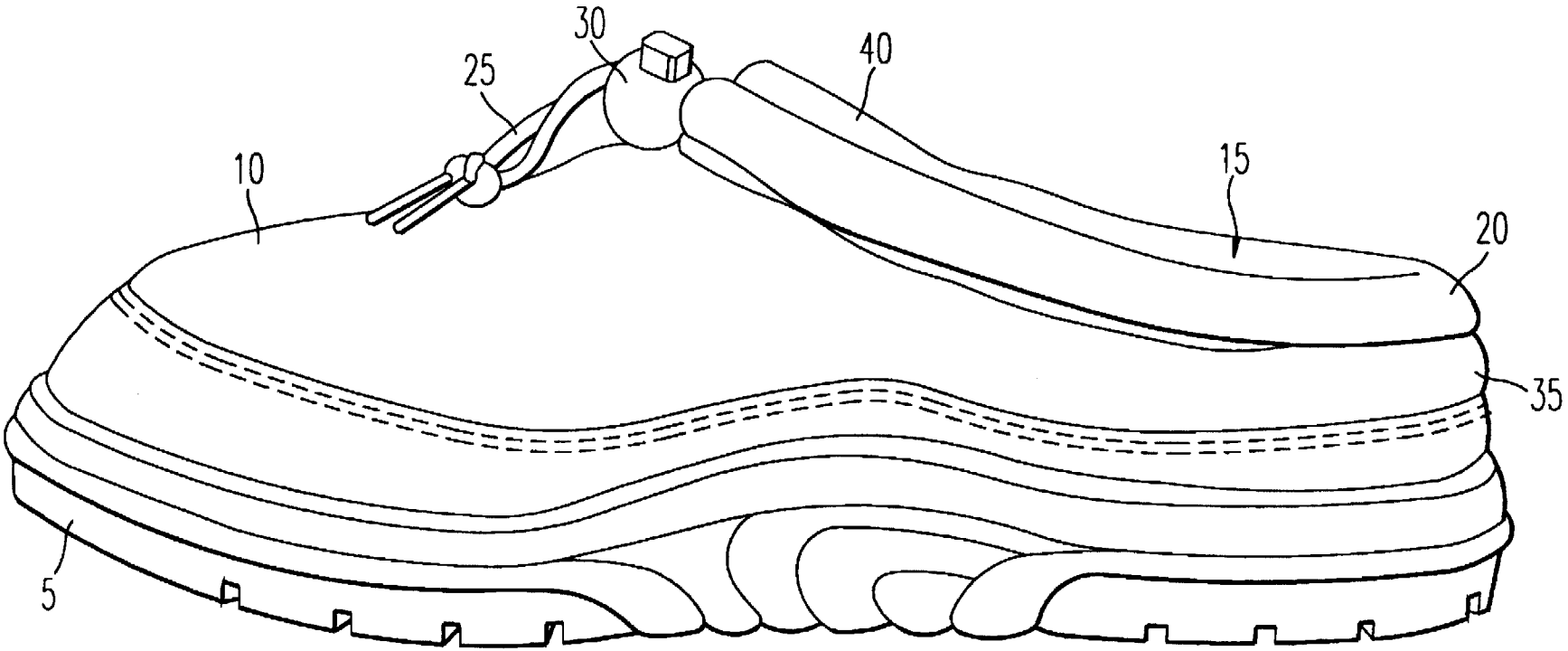
FIG. 1 shows a perspective view of a clog type shoe according to the present invention.

Referring now to the drawings, wherein like reference numerals designate identical or corresponding parts throughout the several views, and more particularly to FIGS. 1–11 thereof, the clog type shoe of the present invention is shown.

Figure 11:
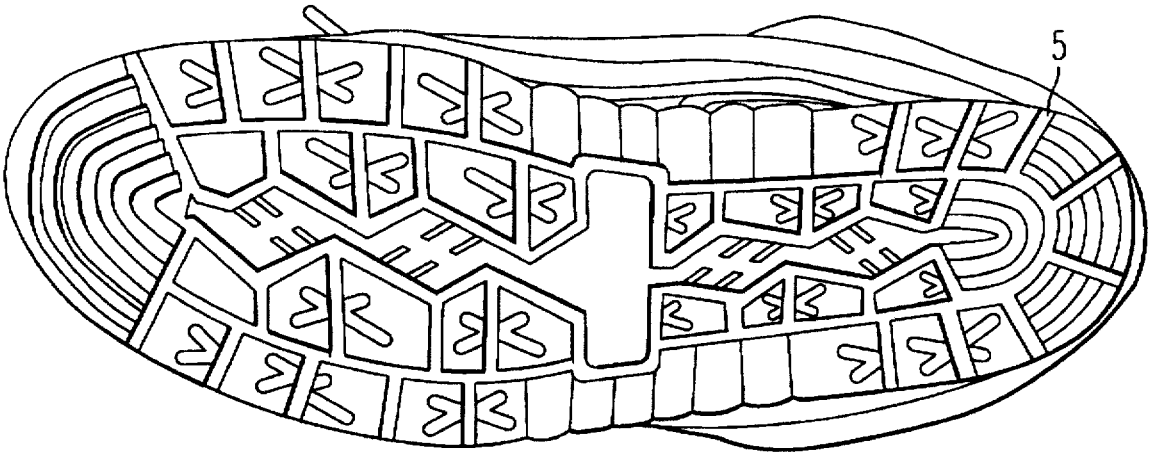
FIG. 11 shows a view of the sole of the clog type shoe according to the present invention.

As is shown in these FIGS. 1–11, the clog type shoe of the present invention includes a sole 5. The sole 5 may typically be formed of a hard resin plastic having a tread as shown in FIG. 11, or may also be formed of wood. As one embodiment, the sole 5 may be made of an expanded PVC (poly vinyl chloride) and a solid PVC forming what may be referred to as a "dual lensity sole". Furthermore, in the present invention, and as is most clearly shown in FIG. 3, formed into a center portion of this sole 5 is a midsole 51. This midsole 51 may be made of a non-woven fabric. Further, this midsole 51 formed of the non-woven fabric is provided to offer both lateral stability and to provide insulation.

Figure 2:
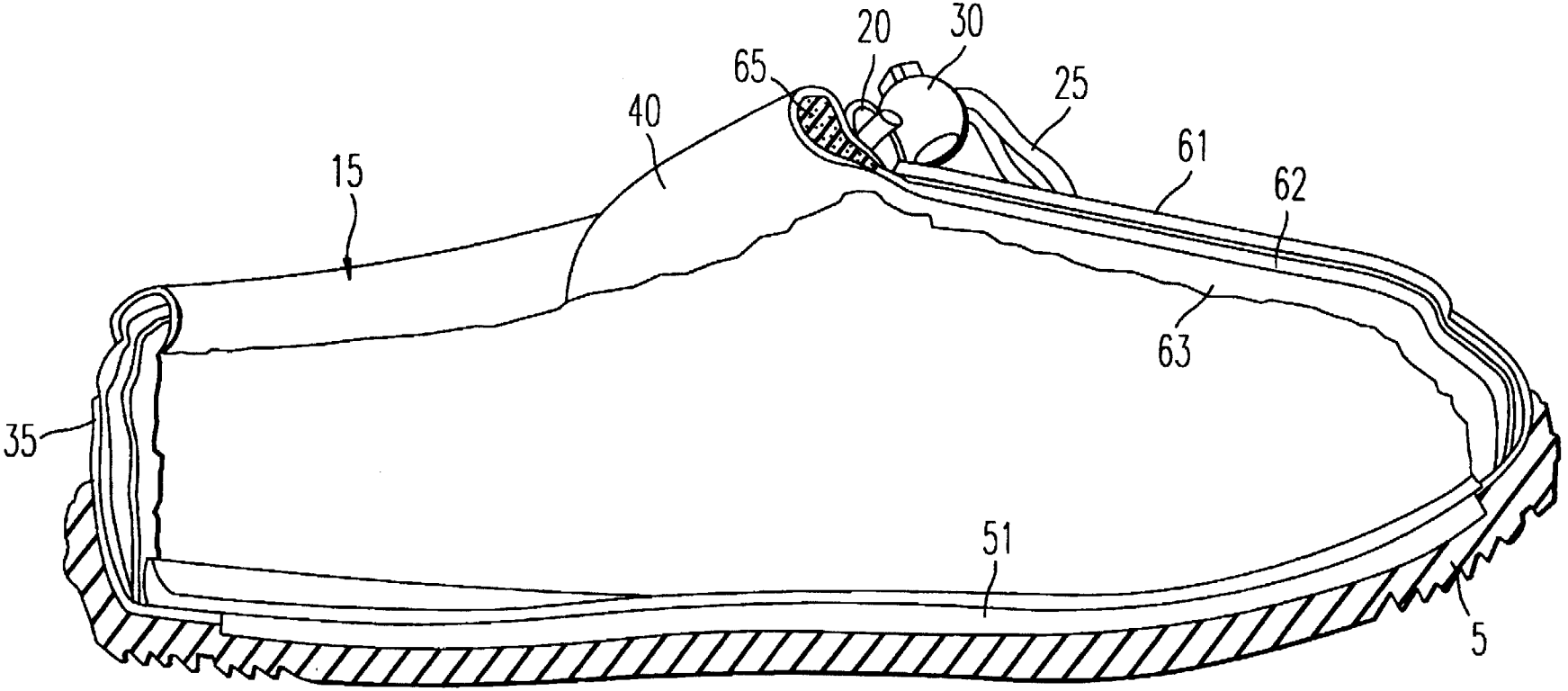
FIG. 2 shows a lengthwise cut-away view of the clog type shoe according to the present invention.
Figure 3:
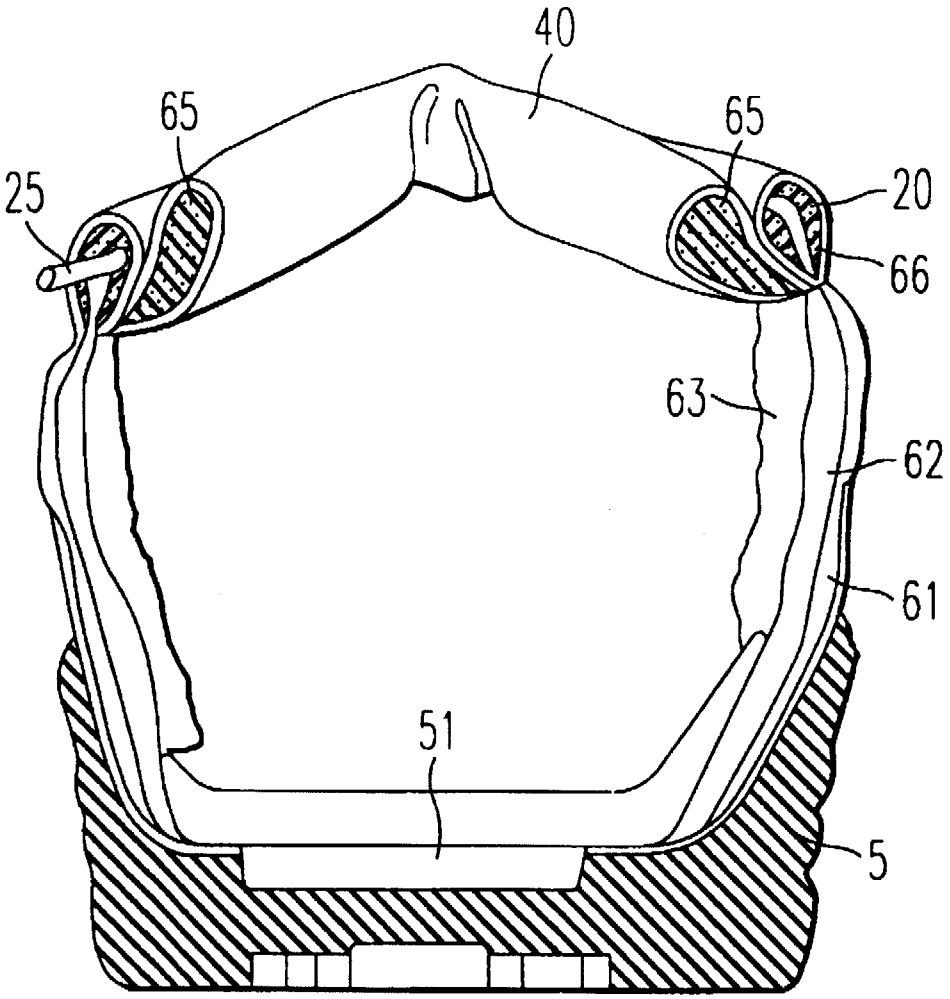
FIG. 3 shows a widthwise cut-away view of the clog type shoe according to the present invention.
Figure 4:
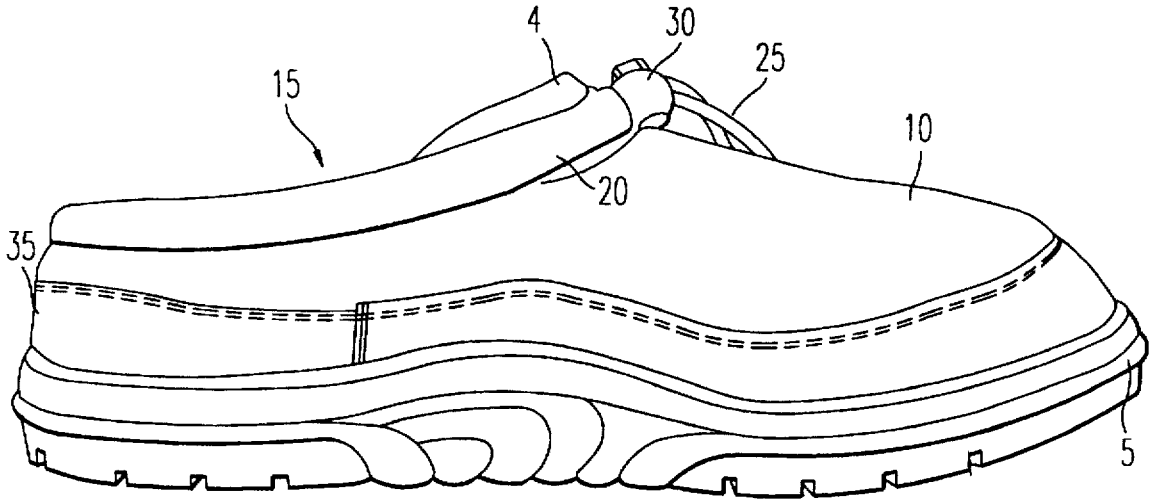
FIGS. 4 and 5 show side views of the clog type shoe according to the present invention.
Figure 5:
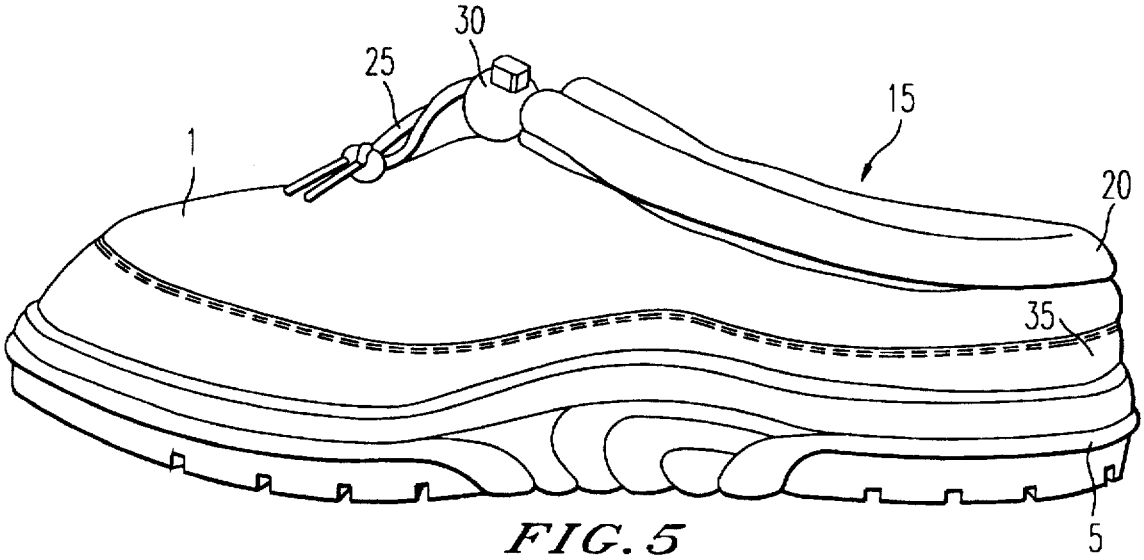
Figure 6:
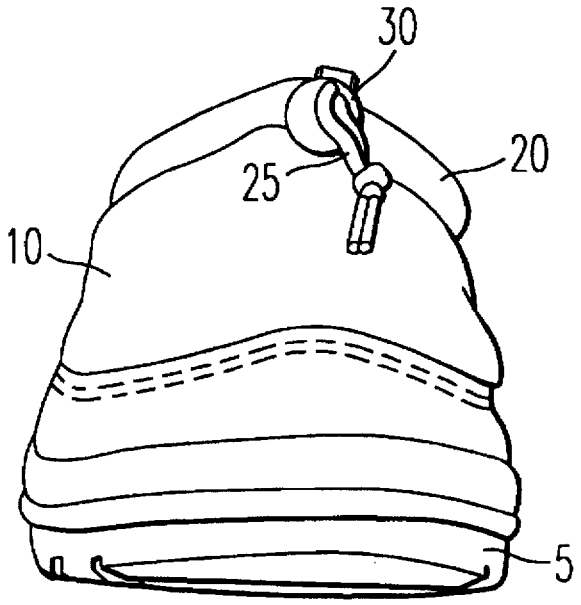
FIG. 6 shows a front view of the clog type shoe according to the present invention.
Figure 7:
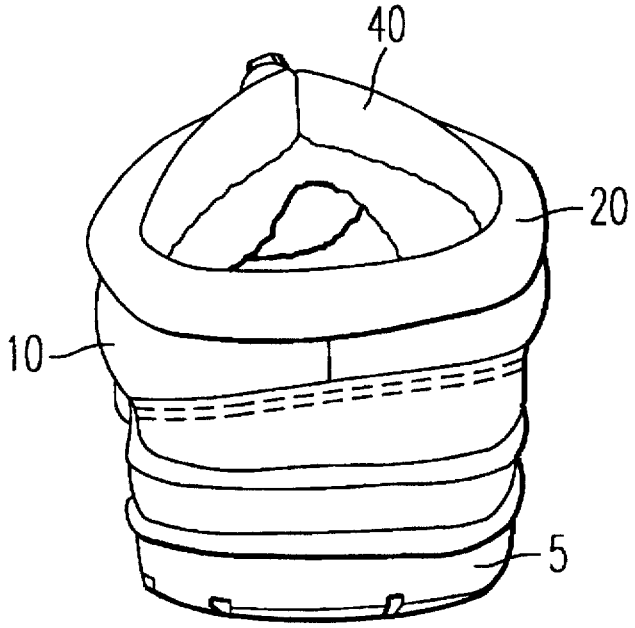
FIG. 7 shows a back view of the clog type shoe according to the present invention.
Figure 8:
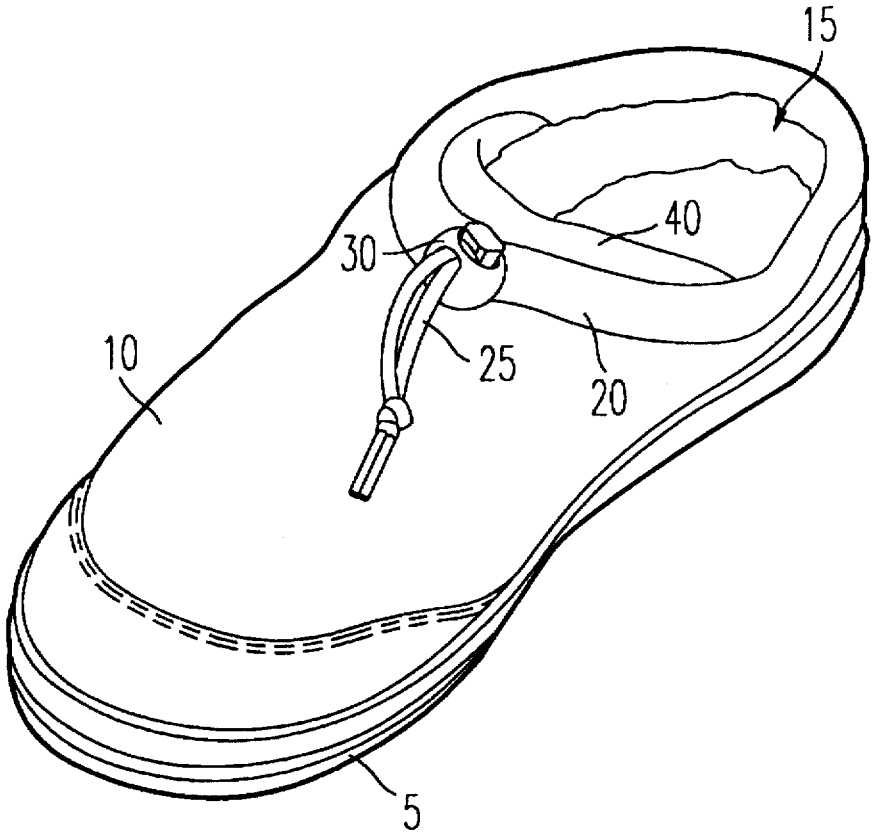
FIGS. 8 and 9 show further perspective views of the clog type shoe according to the present invention.
Figure 9:
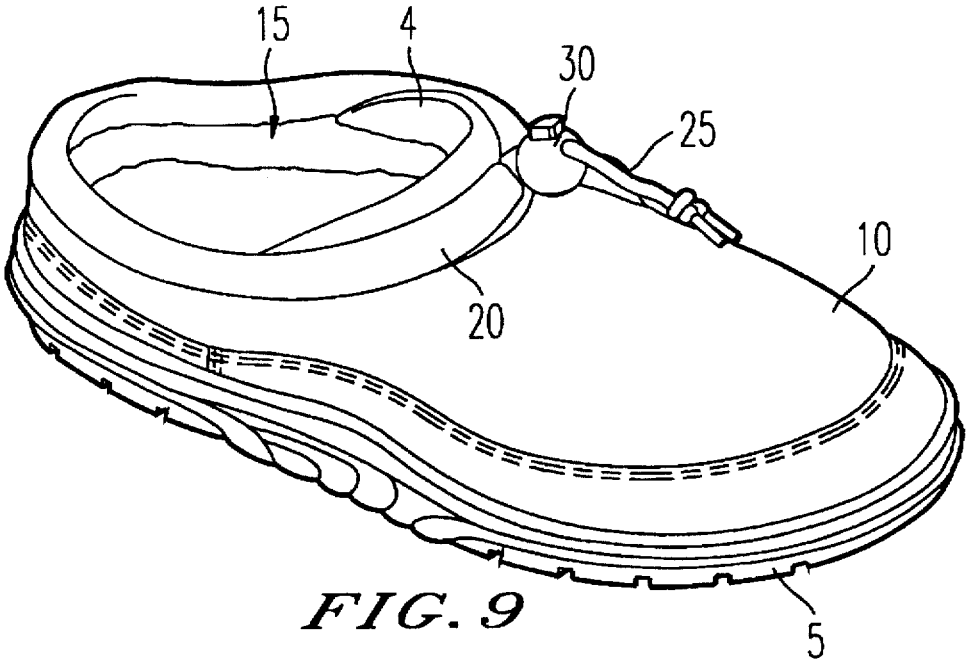
Figure 10:
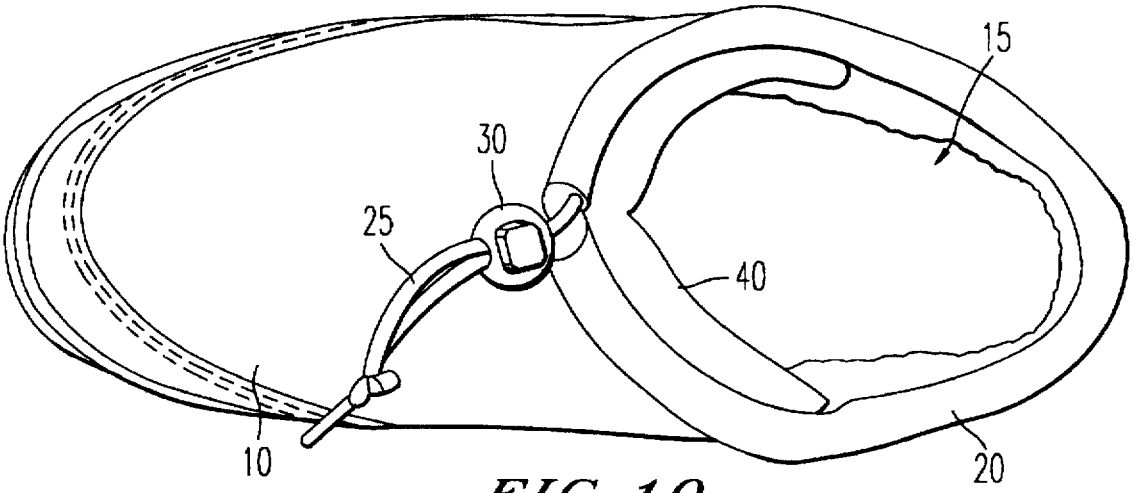
FIG. 10 shows on top view of the clog type shoe according to the present invention.

Attached to this sole 5 is an upper 10. This upper 10 may typically be formed of a single unitary piece, formed of leather, suede, canvas, polar fleece, etc. This upper 10 has an opening 15 through which a wearer's foot is placed. As one embodiment of the present invention, the upper 10 may be formed of a three-ply layered package, which can provide both warmth and comfort. As is shown in FIGS. 2 and 3, the outer layer 61 may be formed of a lightweight and durable material such as sold under the trademark POLAR FLEECE manufactured by Malden Mills, the inner layer 62 may be formed of an insulating material, such as sold under the trademark THINSULATE manufactured by 3M, and the inner layer 63 may be formed of a comfortable inner lining material such as sold under the trademark POLARTEC Sherpa manufactured by Malden Mills. With such a layered structure, the upper 10 of the present invention provides both warmth and comfort in a lightweight and comfortable design. More or less layers could be implemented in such an upper 10 of the present invention.

In the present invention as shown in FIGS. 1–10, the upper 10 also includes a heel lip portion 35 which extends above the heel of the sole 5. That is, according to the present invention, the upper 10 is formed around an entire periphery of the sole 5. This lip portion 35 is placed so that the wearer's foot placed within the clog shoe is securely held in place. That is, in background clogs the upper does not extend to a heel portion of the clog, i.e., the heel portion is open so that a wearer's foot can easily slide into the clog and easily slide out of the clog. The present invention has a contrary structure in that the clog shoe of the present invention has a lip portion 35 formed so that the upper 10 is formed around a complete periphery of the sole 5. The present invention utilizes such a lip portion 35 structure so that a wearer's foot is more securely held within the clog shoe.

Furthermore, in the present invention the upper 10 includes a drawstring tunnel 20. The drawstring tunnel 20 is a padded hollow portion which is formed around an entire circumference of the opening 15. The drawstring tunnel 20 can be formed of a foam backed to a lightweight knitted nylon fabric. This drawstring tunnel 20 is padded with a padding 66 for comfort. Furthermore, threaded through the hollow portion of the drawstring tunnel 20 is a drawstring 25. In this way, this drawstring 25 completely encircles the opening 15 of the upper 10 through the center of the drawstring tunnel 20. This drawstring 25 may also include a locking member 30 which maintains a desired tension on the drawstring 25. The locking member 10 can be a molded plastic lock, such as an orb lock cord manufactured by A. H. Miller Corp.

With this structure of the present invention, when the drawstring 25 is pulled tight, the drawstring secures the clog type shoe on the wearer's foot. The tension on the drawstring 25 can also be maintained by locking the locking member 30.

As is also shown in FIGS. 1–3, as a further feature the present invention includes a padded flap 40 which is attached to an underside of a forefoot portion of the opening 15 in the upper 10 of the clog shoe. This padded flap 40 may be made of neoprene, and backed on both sides of the neoprene may be a lightweight nylon knitted fabric. This padded flap 40 includes an internal padding 65. This padded flap 40 is provided for comfort as in the present invention the clog will be closely wrapped around a wearer's foot and ankle at the opening 15. Thus, this padded flap 40 provides for extra comfort particularly when the drawstring 25 is tightened so that the opening 15 is formed closely around a wearer's foot.

In this way, the clog type shoe of the present invention provides a structure in which the clog type shoe is secured to a wearer's foot, and which is warm, comfortable and lightweight. Such a clog type shoe of the present invention is particularly adapted for active uses.

Obviously, numerous modifications and variations of the present invention are possible in light of the above teachings. It is therefore to be understood that within the scope of the appended claims, the present invention may be practiced otherwise than as specifically described herein.

What is claimed as new and desired to be secured by Letters Patent of the United States is:

1. A footwear comprising:

a sole;

an upper attached to the sole, the upper being formed as a unitary element having an opening through which a foot is placed and which is angled relative to the sole from a heel portion toward a forefront of the sole, the upper comprising:

an opening through which a foot is placed;

a drawstring tunnel formed to encircle the opening;

a drawstring threaded through the drawstring tunnel.

2. The footwear according to claim 1, further comprising a locking unit for locking a desired tension on the drawstring.

3. The footwear according to claim 1, further comprising: a padded flap attached to an underside of a forefoot portion of the opening.

4. The footwear according to claim 1, wherein the upper further comprises a lip portion formed at a heel of the sole.

5. The footwear according to claim 1, wherein the drawstring tunnel is padded.

6. The footwear according to claim 1, wherein the upper comprises an inner layer, an outer layer and a middle layer of an insulating material formed between the inner layer and the outer layer.

7. The footwear according to claim 1, wherein the sole comprises a midsole made of a non-woven fabric.

8. The footwear according to claim 1, further comprising locking means for locking a desired tension or the drawstring.

9. The footwear according to claim 8, wherein the locking means comprises a molded plastic locking element.

10. A footwear comprising:

a sole including a non-woven fabric midsole section;

an upper attached to the sole, the upper being formed as a unitary element having an opening through which a foot is placed and which is angled relative to the sole from a heel portion towards a forefront of the sole, the upper comprising:

an opening through which a foot is placed;

a padded drawstring tunnel formed to encircle the opening;

a drawstring threaded through the drawstring tunnel;

a padded flap attached to an underside of a forefoot portion of the opening; and a lip portion formed at a heel of the sole; a locking unit for locking a desired tension on the drawstring.

11. The footwear according to claim 10, wherein the upper is formed of an inner layer, an outer layer and a middle layer of an insulating material formed between the inner layer and outer layer.

* * * * *